United States Patent [19]

Preisig

[11] Patent Number: 4,506,874

[45] Date of Patent: Mar. 26, 1985

[54] PILE PRESSING DEVICE

[75] Inventor: Roland Preisig, Yens, Switzerland

[73] Assignee: Bobst SA, Lausanne, Switzerland

[21] Appl. No.: 497,412

[22] Filed: May 24, 1983

[30] Foreign Application Priority Data

Jun. 1, 1982 [CH] Switzerland ..... 3353/82

[51] Int. Cl.[3] ..... B65H 3/04; B65H 3/54

[52] U.S. Cl. ..... 271/35; 271/3.1; 271/165; 414/907

[58] Field of Search ..... 271/35, 3.1, 160, 165, 271/166, 131, 138, 144, 4, 5, 6, 96, 104, 105, 127; 414/907, 130

[56] References Cited

U.S. PATENT DOCUMENTS 3,800,678 4/1974 Wiedemann et al. ..... 271/35 X 3,874,652 4/1975 Bilbrey ..... 271/35

3,941,372 3/1976 Matsuo ..... 271/104 X

*Primary Examiner*—Bruce H. Stoner, Jr.

*Assistant Examiner*—Lawrence J. Goffney

*Attorney, Agent, or Firm*—Hill, Van Santen, Steadman & Simpson

[57] ABSTRACT

A device for pressing a pile of sheets in a feeding unit or station including a vertically movable pressing carriage with a pressing device being guided in a vertical path formed by rails and a groove provided in a front surface of a gauge of the feeding unit. The pressing device includes a sensing arrangement acting on a switch connected in a control circuit for a pneumatic drive so that when introducing an additional batch of sheets into the feeding station the sensing device actuates the pneumatic piston to retract the pressing device to provide clearance for the additional batch.

4 Claims, 4 Drawing Figures

PILE PRESSING DEVICE

BACKGROUND OF THE INVENTION

The present inventon is directed to a device for pressing a pile of sheets in a feeding unit or station such as the feeding station of a folder-gluer.

In folder-gluers known so far, the sheets are transferred from a feeding station to another station of the machine by conveyor means having a plurality of endless lower belts which are arranged underneath a pile of sheets which are to be introduced into the machine. These lower belts are operated with means for preventing passage of more than one sheet from the bottom of the stack which means include one or several frontal stops called gauges or gates each having a lower edge. The gauges are positioned so that the lower edge is spaced above the surface of the belt a distance equal to slightly more than the thickness of one sheet.

During processing of sheets of corrugated cardboard, it is often difficult to draw only the lowermost sheet from the bottom of the pile. This difficulty is due to the fact that it is hard to vertically adjust the lower edge of the gauge with regard to the thickness of the cardboard. This adjustment is quite easy when processing solid pasteboard or cardboard sheets. However, if the machine is processing corrugated cardboard, the operation becomes more difficult because while the thickness of the sheet may be constant, the sheets tend to curve and thus it does not lie in a single plane. As is obvious, the excessive bending of a corrugated cardboard sheet will cause difficulty with passage of the sheet below the gauges due to the effective thickness of the sheet being different at different locations. Thus, corrugated cardboard sheets cause problems at the feeding station.

Simple solutions have already been suggested to compensate for these inconveniences created by the corrugated cardboard sheets. One of the solutions recommends the use of a presser mounted on top of the pile of sheets to be introduced into the machine. This device acts along a plane which is defined by the gauges and presses the pile to thus flatten the sheets in the pile. Consequently, all the sheets in the pile will have the same thickness at the location of the gauge.

The device mentioned hereinabove is made of one or several counterweights mounted on guiding rails. These counterweights are freely movable along the guiding rails and shift downward toward the lower endless belts of the feeder when the sheets are introduced into the machine. When the feeder is to be resupplied with a new pile or batch of sheets, these counterweights have to be lifted manually and kept in their elevated position during the loading of a new pile into the feeding apparatus. This device is quite economical as it does not require expensive equipment to built the counterweight system. However, the loading of a new pile of large sheets into the feeder can be difficult. The operator has to use both hands to load the large sheets into the feeder since the pile is heavy and not easy to handle. Consequently, he cannot lift and hold the counterweights which act on the pile and simultaneously load the new batch of sheets into the feeder. This requires the operator to either request help from another person or to use several steps to load the sheets into the feeder. Because of these problems with loading new sheets into the pile, the production of the folded and glued boxes by the folder-gluer is disturbed or even slowed down.

SUMMARY OF THE INVENTION

The present invention is directed to eliminating the above mentioned drawbacks of the pressing device by offering the operator of a folder-gluer a pile pressing device which leaves his hands free for the loading operation of a new batch of sheets.

To accomplish these aims, the present invention is directed to a device for pressing a pile of sheets in a feeding station unit, said feeding unit having a conveyor means with continuous belts for transporting a bottom sheet in a pile of sheets and means for preventing passage of more than one sheet at a time from the bottom of the pile, said means including a gauge with a lower edge, support means including a support member for mounting the gauge in the feeding unit with the lower edge spaced above the belt of the conveyor means by the desired distance. The device comprises a pressing carriage; a vertical path defined by at least one vertically extending rail mounted on the support member and a vertically extending slot on a surface of the gauge, said carrier having slide elements engaging the groove and each rail to guide the carriage along the vertical path, a pressing device mounted on the carriage including an infeed guide with an aperture; sensor means for determining contact with a batch of sheets being loaded into the feeding station including a switch mounted in said aperture of the infeed guide, a sensor plate and means mounting the sensor plate on the infeed guide for pivotal movement into and out of contact with the switch; and drive means for moving the carriage along the vertical path including a pneumatic piston mounted on a support having a piston rod attached to the infeed guide, setting means for adjusting the pressure of the piston holding the guide in contact with a pile, a drive means for commanding the vertical shifting and control means for checking the elevating and lowering speed so that the drive means continuously moves the pressing carrier and infeed guide downwardly to maintain the desired contact on the pile and when the sensing means detects the insertion of a new batch of sheets which trip the switch, the drive means reverses the movement to elevate the carriage to supply room for the added batch of sheets.

Preferably, the support means for each of the gauges includes an adjustable mount which allows lateral adjustment of the position of the gauge and the device for pressing in the feeding unit., Preferably, the drive circuit enables coupling additional pressing devices so that a single source of pneumatic fluid or compressed air can be utilized. In addition, the sensor blade preferably includes lateral flanges which have adjustable stops to enable controlling the amount of pivotal movement thereof.

DESCRIPTION OF THE PREFERRED EMBODIMENTS

Figure 1:
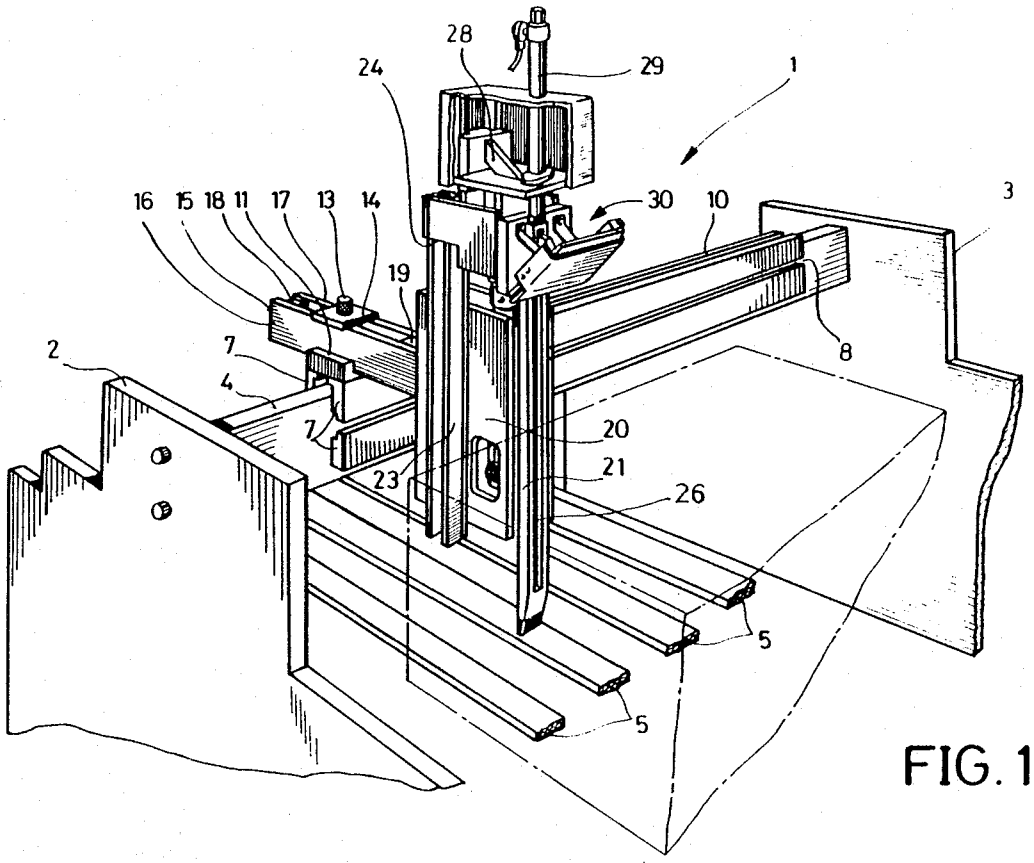
FIG. 1 is a perspective schematic view of a feeding station being provided with the device in accordance with the present invention.
Figure 2:
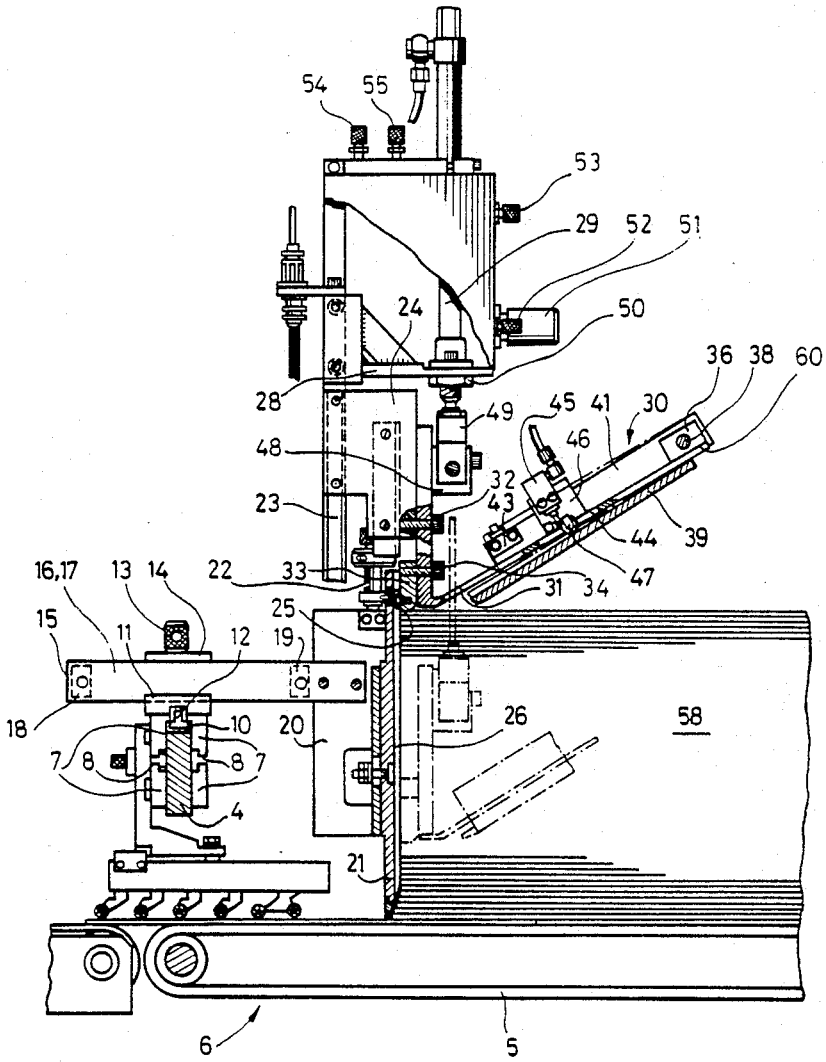
FIG. 2 is a longitudinal cross-sectional view of the device of FIG. 1 in a feeding station with portions in elevation and with portions broken away for purposes of illustration.

The principles of the present invention are particularly useful for a device for pressing a pile of sheets in a feeding unit or station which is generally indicated at 1 in FIG. 1. The feeding unit or station 1 has two lateral frames 2 and 3 which are held together in parallel arrangement by a crosspiece 4. The unit or station 1 has a conveyor means 6 (FIG. 2) which has a plurality of endless belts 5 which are spaced between the two lateral frames 2 and 3 (FIG. 1). The cross-piece 4 has rails 7 which are secured to it by fastening means such as screws (not shown). These rails are arranged so that their profile creates grooves 8 and 10 which are best illustrated in FIG. 2. A U-shaped base plate or stirrup 11 is adjustably mounted on the upper surface of the crosspiece 4 by a "T" nut 12 which is engaged with a tightening screw 13 that passes through a plate 14. As illustrated, an arm 15 is positioned between the plate 14 and the base plate 11. The arm 15 is made of two lateral plates 16 and 17 which (best illustrated in FIG. 1) are spaced apart by braces 18 and 19.

Figure 3:
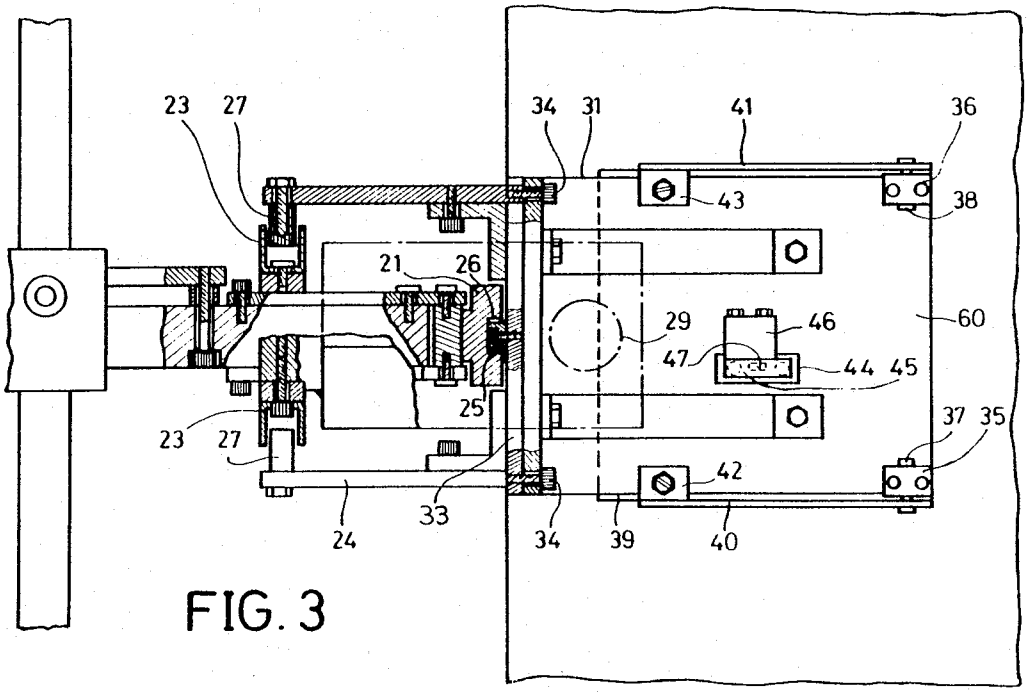
FIG. 3 is a plan view with portions broken away and removed for purposes of illustration of the device of FIG. 2.

A support member 20, which is composed of parallel extending plates, is attached to the arm 15 and provides a mounting for a guage or gate 21. The gauge 21 is vertically adjusted by means of a setting screw 22 (FIG. 2). Each wall of the plates forming the support member 20 is provided with vertically extending slide elements or rails 23 (FIGS. 1 and 2) on which a pressing carriage 24 is engaged. The carrier 24 is guided on the rails 23 with the help of slides 27 (FIG. 3). The pressing carriage 24 is also guided with the help of a guiding slide 25 which is received in a groove 26 which is provided on a front surface of the gauge 21. A support 28, which has an L-shaped configuration as illustrated in FIG. 2, is mounted on the upper end of each of the two rails 23. The support 28 holds a pneumatic piston 29 which raises and lowers a pressing device 30 which is secured onto the pressing carriage 24. The unit 1 can be adjustably positioned along the transverse directions of the rails 7 by means of the adjustable mounts of the stirrup 11.

The pressing device 30 includes an infeed guide 31 which is secured on a front part of the pressing carriage 24 by means of screws 32. A supporting blade 33 is secured by screws 34 onto a lower part of the guide 31. The supporting blade 33, which is equipped with the guide slides 25, presses the leading edge of a pile 58 by engaging the top sheet therof. The guide 31 has a plate portion 60 equipped with bearings 35 and 36 (FIG. 3) which receive axles 37 and 38 supporting a sensor plate 39 which has two flanges 40 and 41. Two shiftable stops 42 and 43 are mounted on these flanges and can be adjusted to engage an upper surface of the plate 60 to limit the pivoting of the plate 39 in a counterclockwise direction. As best illustrated in FIG. 3, the infeed guide 31 has an aperture 44 and a switch 45, which is mounted on a block 46, is mounted with its roller contact 47 (FIG. 2) extending in and partially through the aperture 44. Thus, the roller 47 of the switch 45 will be engaged by the sensor plate 39 as it pivots in a clockwise direction against the plate portion 60 of the guide 31.

An upper portion of the infeed guide 31 is provided with a lug 48 which receives a fork 49 that is secured on the end of a piston rod of the pneumatic piston 29. The pneumatic piston 29 will be driven by a pneumatic circuit which includes the switch 45. The circuit also includes a setting means or element 51 which adjusts the pressing force, drive means or element 52 which commands the vertical shifting of the pressing device 30 and a controlling element or means 53 for checking the elevation and lowering speed of the pressing device 30.

If the sheets of the pile are made in the transverse direction, the arrangement of several pile-pressing devices along the transverse width of the feeding station 1 is desirable. Thus, the control includes two couplings 54 and 55, which are mounted on an upper part of the device and are used for coupling the control circuit of one pressing unit with another so that a single source of compressed air can be utilized to operate all the units.

Figure 4:
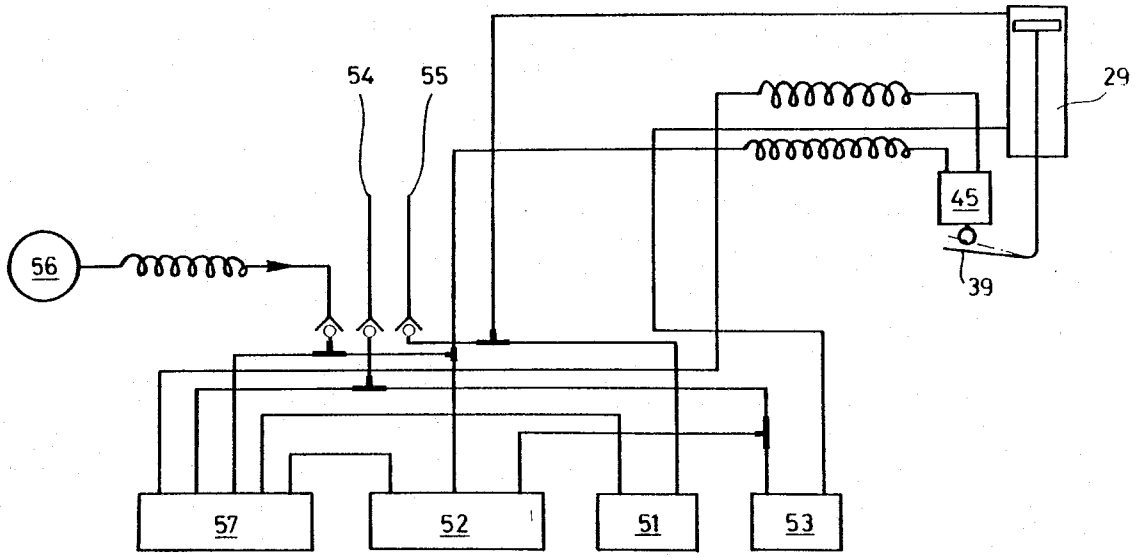
FIG. 4 is a schematic view of the pneumatic drive of the device in accordance with the present invention.

As best illustrated in FIG. 4, the pneumatic circuit includes a compressed air supplied from a source 56 which is blasted through a check valve to a distributor 57 as well as to a drive means or temporisator element 52 and the switch 45. The compressed air is then distributed from the distributor 57 to various elements 51, 52 and 53 to control the motion of the pneumatic piston 29.

The distributor 57 is pneumatically driven either by compressed air comming from the switch 45 or by air comming from the temporisator element 52. the distributor 57 dispatches air to the piston 29 in order to command the up and down motion of the piston 29. The setting means 51 allows to optimize the force applied on to the pile 58 and the controlling means 53 which is a flow regulator controlling the speed of the up and down motion of the piston 29. The drive means 52, which is a time delayer, is destined to delay the moment of the reverse motion of the piston 29.

The pressing device operates in the following. When a batch of sheets is being loaded on the endless belts 5 of the conveyor means 6, the sensor plate 39 of the pressing device 30 will be pushed and cause the roller or follower 47 of the switch 45 to activate the switch. The activation of the switch 45 lifts the pneumatic piston 29. But the switch 45 is connected with the drive element 52 which, if properly adjusted, is going to progressively restore the air pressure in the pneumatic piston 29 causing it to move down again. The air pressure delivered to the pneumatic piston 29 can be adjusted by means of the setting element 51 which allows a modification of the pressing force of the pressing device 30 on an upper face of the pile 58 of sheets. It should be noted that the pressing device engages the upper sheet with the supporting blade 33 and that in a normal operation, the sensing plate 39 of the sensing means does not engage the upper surface but is pivoted to a position out of contact with the switch 45 which is deactivated. Thus, in this position, which is shown in bold lines in FIG. 2, air is delivered through the setting means 51 to move the piston in a downward direction.

Each time the sensor plate 39 is contacted by the front part of a new batch of sheets being introduced to the pile 58, the pressing device 30 is lifted and momentarily liberates the front part of the pile 58 from any pressure as the batch is being introduced into the feeding station 1. It thus allows the loading of a new batch on top of a previous batch without any manual removal of the pressing device 30 from its operating location. As soon as the new batch is properly loaded, the pressing device will again engage the top sheet of the newly constituted pile. Of course, an adequate setting lifts the pressing device 30 just enough to allow the loading of the new batch. Thus, the time, while the batch is to be introduced into the feeding station of the folder-gluer and while the pile in the folder-gluer is not under pressure, remains as short as possible. Thus, with the pile-pressing device removed temporarily, the operator has a simplified and rapid loading of the feeding station 1 without requiring the help of another operator even when loading or processing large sheets.

Although various minor modifications may be suggested by those versed in the art, it should be understood that I wish to embody within the scope of the patent granted hereon, all such modifications as reasonably and properly come within the scope of my contribution to the art.

I claim:

1. A device for pressing a pile of sheets in a feeding station, said feeding station having conveyor means with continuous belts for transporting a bottom sheet in a pile of sheets and means for preventing passage of more than one sheet at a time from the bottom of the pile, said means including a gauge with a lower edge, support means including a support member for mounting the gauge in the feeding station with the lower edge spaced above the surface of the belt of the conveyor by the required distance, said device comprising a pressing carriage; a vertical path defined by at least one vertically extending rail mounted on the support member and a vertically extending groove on a surface of the gauge, said carriage having slide elements engaging the groove in each rail to guide the carriage along the vertical path; a pressing device mounted on said carriage including an infeed guide with an aperture; sensing means for determining contact with a batch of sheets being introduced to the pile including a switch mounted in said aperture of the infeed guide, a sensing plate and means for mounting the sensing plate on the infeed guide for pivotal movement into and out of contact with the switch; and drive means for moving the carriage along the vertical path including a pneumatic piston mounted on a support having a piston rod attached to the infeed guide, control means including setting means for adjusting the pressing force of the pressing unit, drive means for commanding the vertical shifting and central means for checking the elevation and lowering speeds as the pneumatic fluid is applied to the piston so that the pressing device maintains a constant pressure on the stack in the feeding station and, when adding an additional batch of sheets to the pile, the sensing means is tripped causing a retraction of the pressing device to provide clearance for inserting of the batch of sheets onto the pile.

2. A device according to claim 1, wherein the support means for mounting the gauge includes an arm secured to the support member, the other end of said arm being adjustably mounted on a cross-piece of the frame of the feeding station so that the device can be adjustably positioned along the transverse direction of the feeding station.

3. A device according to claim 1, wherein the sensing plate of the sensing means has two lateral flanges, each of said flanges having an adjustable stop to limit the direction of movement of the plate in one pivotal direction.

4. A device according to claim 1, wherein a pneumatic circuit for the drive means includes couplings for connecting a drive means of another device to act concurrently therewith.

* * * * *